US007311618B1

(12) United States Patent
Reed et al.

(10) Patent No.: US 7,311,618 B1
(45) Date of Patent: Dec. 25, 2007

(54) BASKETBALL REBOUND TRAINING APPARATUS

(76) Inventors: Lee Allen Reed, 2302 Castle Rock Rd., Quinter, KS (US) 67752; Brian Alan Roesch, 501 Evergreen Row, Quinter, KS (US) 67752

( * ) Notice: Subject to any disclaimer, the term of this patent is extended or adjusted under 35 U.S.C. 154(b) by 279 days.

(21) Appl. No.: 11/194,154

(22) Filed: Aug. 1, 2005

Related U.S. Application Data

(60) Provisional application No. 60/592,564, filed on Jul. 30, 2004.

(51) Int. Cl.
*A63B 69/00* (2006.01)

(52) U.S. Cl. ..... 473/449; 473/447; D21/781

(58) Field of Classification Search ..... 473/422, 473/447–449, 472, 479, 481–489; D21/703, D21/781; 273/402, 317.3
See application file for complete search history.

(56) References Cited

U.S. PATENT DOCUMENTS 3,160,414 A * 12/1964 Gray ..... 473/448
3,173,687 A * 3/1965 Hair ..... 473/449
3,795,401 A * 3/1974 Voltz et al. ..... 473/449
3,910,574 A * 10/1975 Voltz et al. ..... 473/449
4,206,915 A * 6/1980 Woodcock ..... 473/448
4,805,903 A * 2/1989 McArdle ..... 473/489
4,903,964 A * 2/1990 Anderson ..... 473/489
4,921,248 A * 5/1990 Rapp ..... 473/488
5,123,642 A * 6/1992 Stokes ..... 473/489
5,575,470 A * 11/1996 Sherman ..... 473/489
5,816,948 A * 10/1998 Davies et al. ..... 473/485
6,174,249 B1 * 1/2001 Mattoon ..... 473/485
6,572,496 B1 * 6/2003 Brown ..... 473/449

* cited by examiner

*Primary Examiner*—Eugene Kim
*Assistant Examiner*—M. Chambers
(74) *Attorney, Agent, or Firm*—Robert Blinn

(57) ABSTRACT

The present invention is a basketball rebound training apparatus including a rebound unit and an installation tool. The rebound unit includes a dome portion as well as a rim mount structure including a rim catch tab and a latch mechanism. The dome portion is shaped to deflect a basketball shot in a direction that will generally correspond to the likely path and direction of a similar missed shot. The rim catch tab projects under the basketball goal rim while the latch mechanism engages the opposite side of the rim. The installation tool is used to raise the rebound unit for installation on a basketball goal rim.

18 Claims, 11 Drawing Sheets

BASKETBALL REBOUND TRAINING APPARATUS

CROSS REFERENCES TO RELATED APPLICATIONS

This application claims the benefit of U.S. Provisional Patent Application No. 60/592,564 filed Jul. 30, 2004.

FIELD OF THE INVENTION

The present invention relates to a means for mounting a training apparatus to a basketball goal rim and more particularly relates to an apparatus for shielding a basketball goal for practicing basketball rebounding.

BACKGROUND OF THE INVENTION

Retrieving missed attempted shots in the game of basketball, or making rebounds, contributes much toward victory in the game of basketball. Numerous training devices have been devised for helping players improve their ability to make rebounds. Generally such devices include some type of structure that is mounted to the basketball goal to prevent passage of the ball through the basketball hoop. One important disadvantage of present rebound training devices is that they are relatively difficult to install. Because the basketball hoop is elevated ten feet above the playing surface, a typical prior art rebound training device must often be installed and removed using a ladder. The time and effort involved in installing prior art rebound training devices discourage their use. Further, when is ladder is required to install a rebound device, the risk of injury is also increased. It is even the case that when young, but athletically inclined players find they have no ladder, then even more dangerous strategies may be attempted to install a prior art rebound device, namely players actually lifting other players who then install a prior art device.

Some prior art rebound training devices deflect the basketball in a random or unpredictable manner. The random deflection of shots may seem advantageous because it would seem to develop quick player reactions. However, the random deflection of shots actually defeats the object of rebound practice. A rebound training apparatus would preferably deflect a shot in the general direction of a similar missed shot. Deflecting a shot in a direction corresponding to that of a similar missed shot trains players to position themselves on the court at a location where a missed shot may be most likely rebounded. Anticipating the correct location for rebounding is preferable to reacting quickly to the rebound direction. Accordingly, what is needed is a basketball rebound training apparatus which can be easily installed and removed without the use of a ladder and which will generally deflect a shot in a direction generally corresponding to that of a similar missed shot.

BRIEF DESCRIPTION OF THE INVENTION

In an embodiment of the present invention the aforementioned need is addressed by a basketball rebound training apparatus including a rebound unit and an installation tool. The rebound unit includes a rim mount structure and a deflector body. In the present embodiment, the deflector body is generally dome shaped for deflecting a basketball shot in a direction that will generally correspond to the likely path and direction of a similar missed shot. The rim mount structure further includes a peripheral ledge portion, a rim catch portion and a latch mechanism. The peripheral ledge portion presents surfaces for resting upon and fitting inside a rim of a basketball goal. The rim catch portion interrupts the peripheral ledge portion and has a rim catch tab for fitting under the rim of the basketball goal. The latch mechanism also interrupts the peripheral ledge portion and is located generally opposite from said rim catch portion. The latch mechanism includes a latch flange and a latch member pivotably mounted within the latch flange. The latch member has a generally C shaped jaw portion and a lever portion extending from said jaw portion. The latch member pivots between an open position for receiving a basketball rim and a closed position for capturing a basketball rim. The latch member is biased in the closed position. The latch flange also includes a pair of upright holes positioned on either side of the latch member. An installation tool is used to lift the rebound unit to the level of a basketball goal and install the rebound unit. The installation tool includes a support fitting mounted at one end of an support pole. The support fitting has two generally upright pins for engaging the upright holes of the latch flange. The support fitting of the installation tool is also adapted to engage the lever portion of the latch member when the support pole is supporting the rebound unit so that the latch member is urged into the open position. Accordingly, when the rebound unit is supported by the installation tool, the latch member is open for receiving the rim of a basketball goal. When the deflector body is seated into a basketball goal rim, the installation tool may be disengaged from the latch mechanism thus allowing the latch member to bias into the closed position. When in the closed position, the latch member, together with the rim catch portion, captures the basketball goal rim and secures the rebound unit to the basketball goal. When the installation tool support fitting is re-engaged with the latch mechanism, the latch member is urged against its spring bias to the open position thus releasing the basketball goal rim so that the rebound unit may be lifted and removed from the basketball goal.

DETAILED DESCRIPTION

Figure 1:
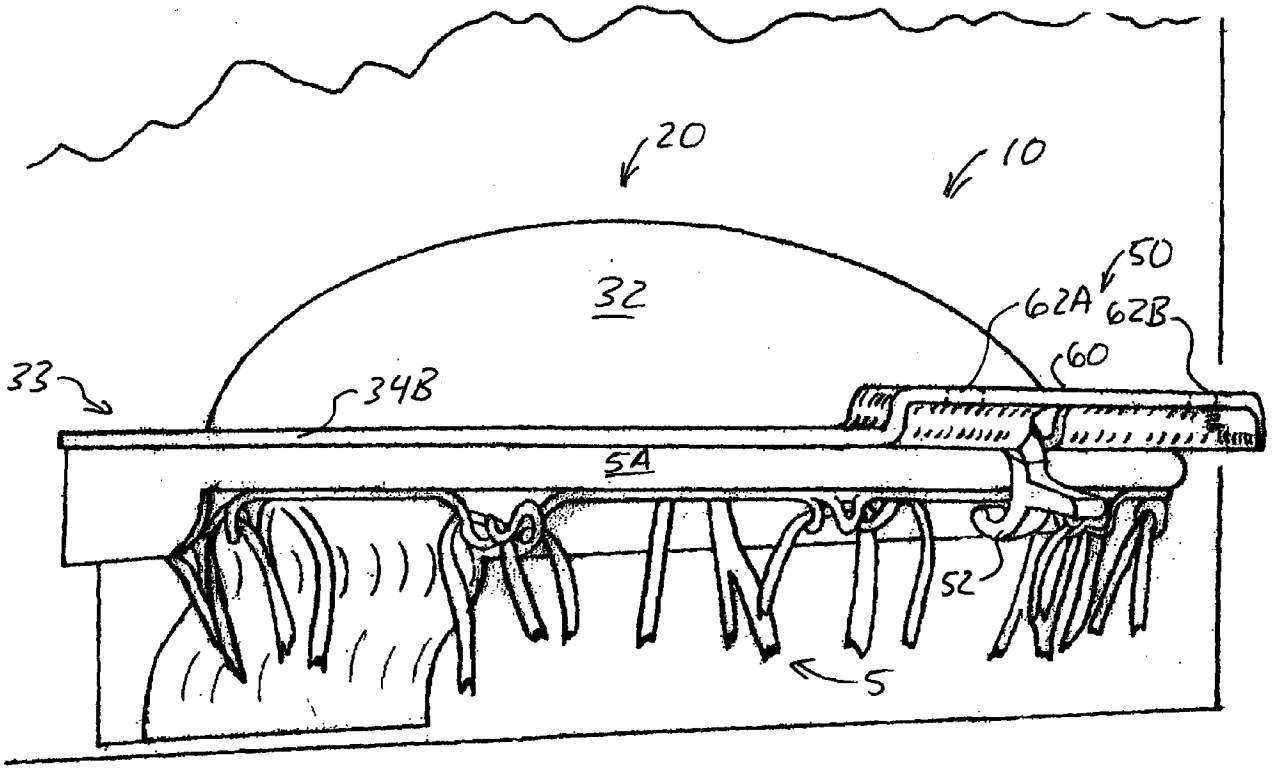
FIG. 1 is a side view of the rebound unit of the basketball rebound training apparatus.

Referring to the drawings, FIG. 1 shows a basketball rebound training apparatus 10 in accordance with an embodiment of the present invention. As can be seen in FIGS. 1-15, basketball rebound training apparatus 10 includes a rebound unit 20 and an installation tool 100.

Figure 2:
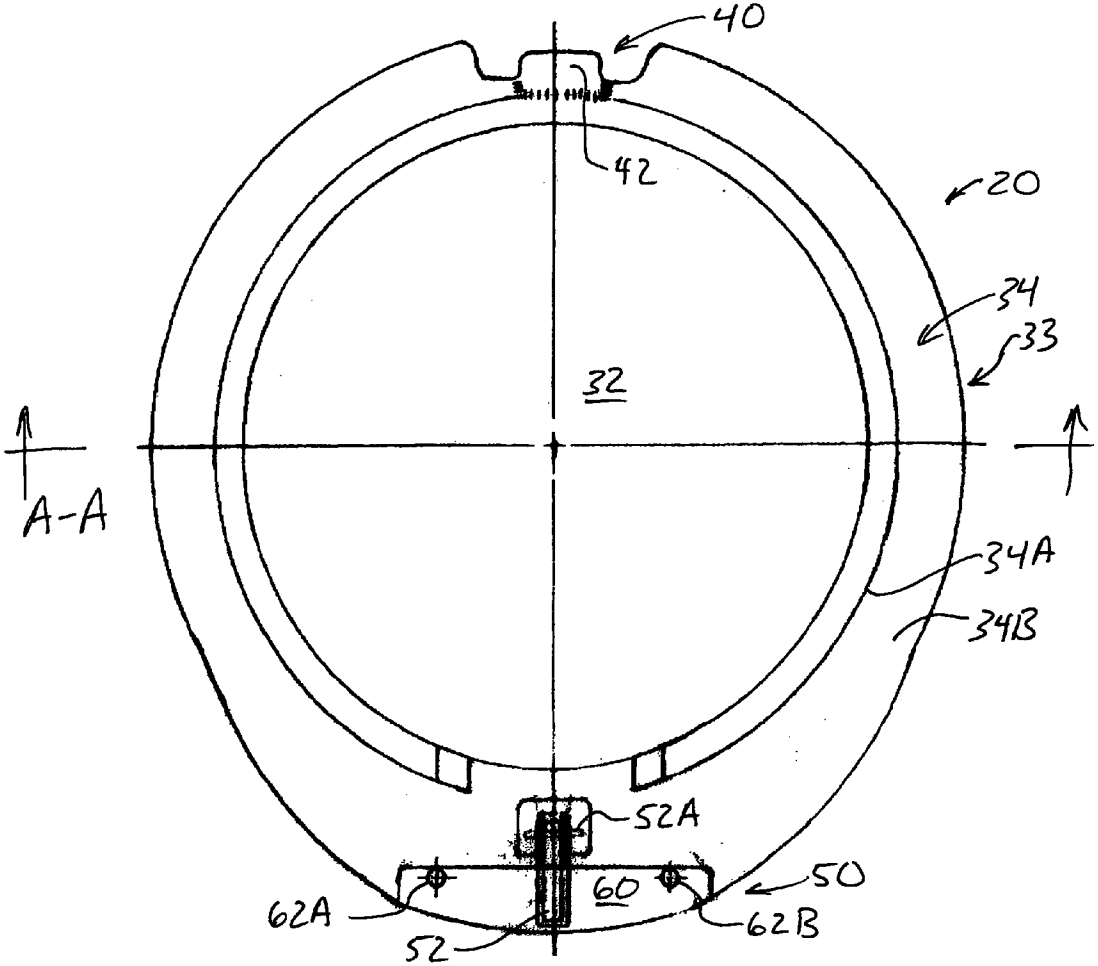
FIG. 2 is a top view of the rebound unit of the basketball rebound training apparatus.

FIG. 1 provides a side view of rebound unit 20 while FIG. 2 provides a top view of rebound unit 20. In FIG. 2, rebound unit 20 is shown in combination with a basketball rim 5A of a basketball goal 5. Rebound unit 20 is preferably fashioned from a vacuum formed generally transparent plastic. As can be seen in FIGS. 1 and 2, rebound unit 20 includes a dome portion 32 and a rim mount structure 33 for mounting dome portion 32 to rim 5A. Rim mount structure 33 further includes a peripheral ledge portion 34, a rim catch portion 40 and a latch mechanism 50.

Figure 2A:
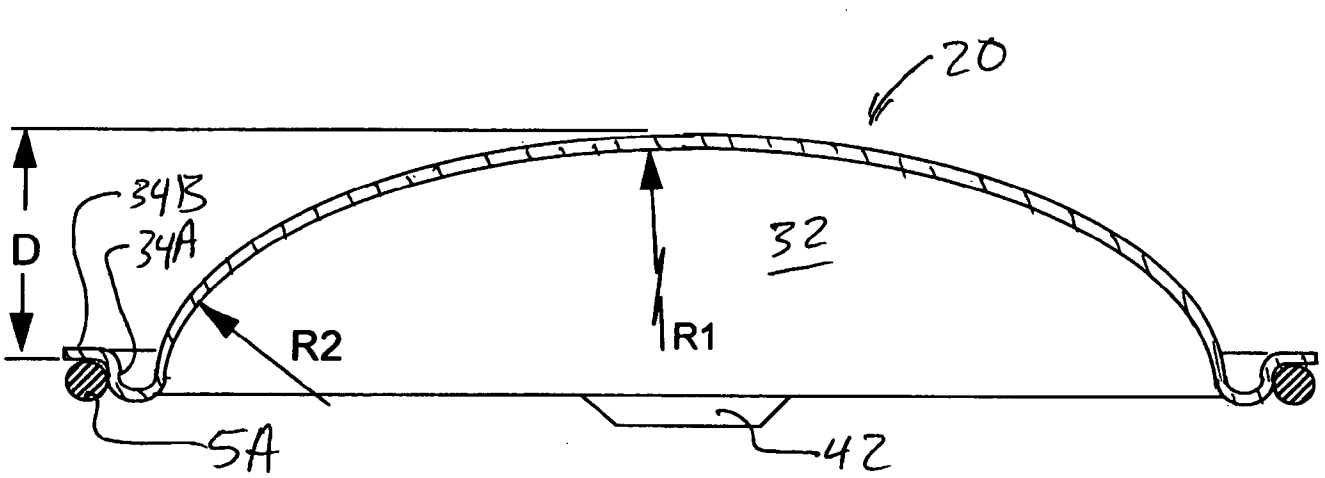
FIG. 2A is a sectional view of the rebound unit taken from plane A-A of FIG. 2.
Figures 3A, 3B:
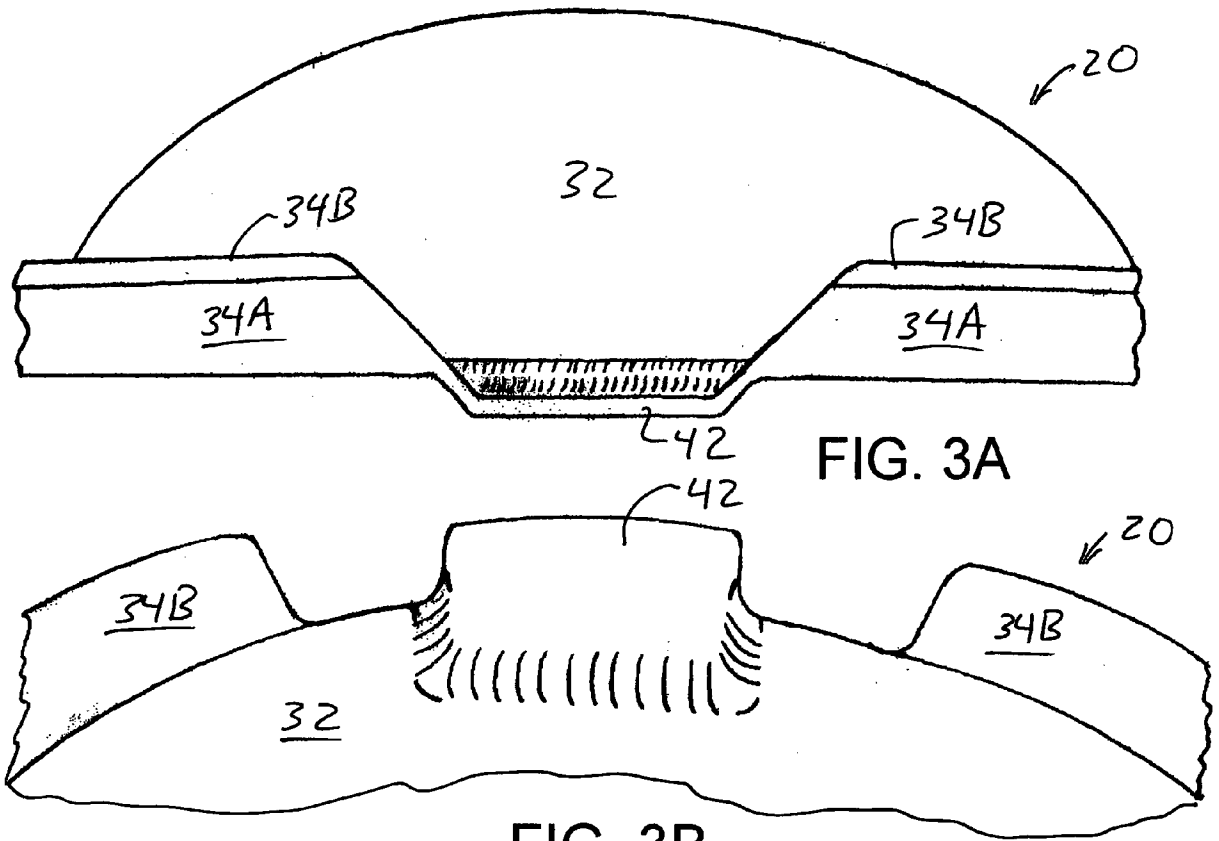
FIG. 3A is a side view of the rim catch portion of the rebound unit.
FIG. 3B is a top view of the rim catch portion of the rebound unit.
Figure 4:
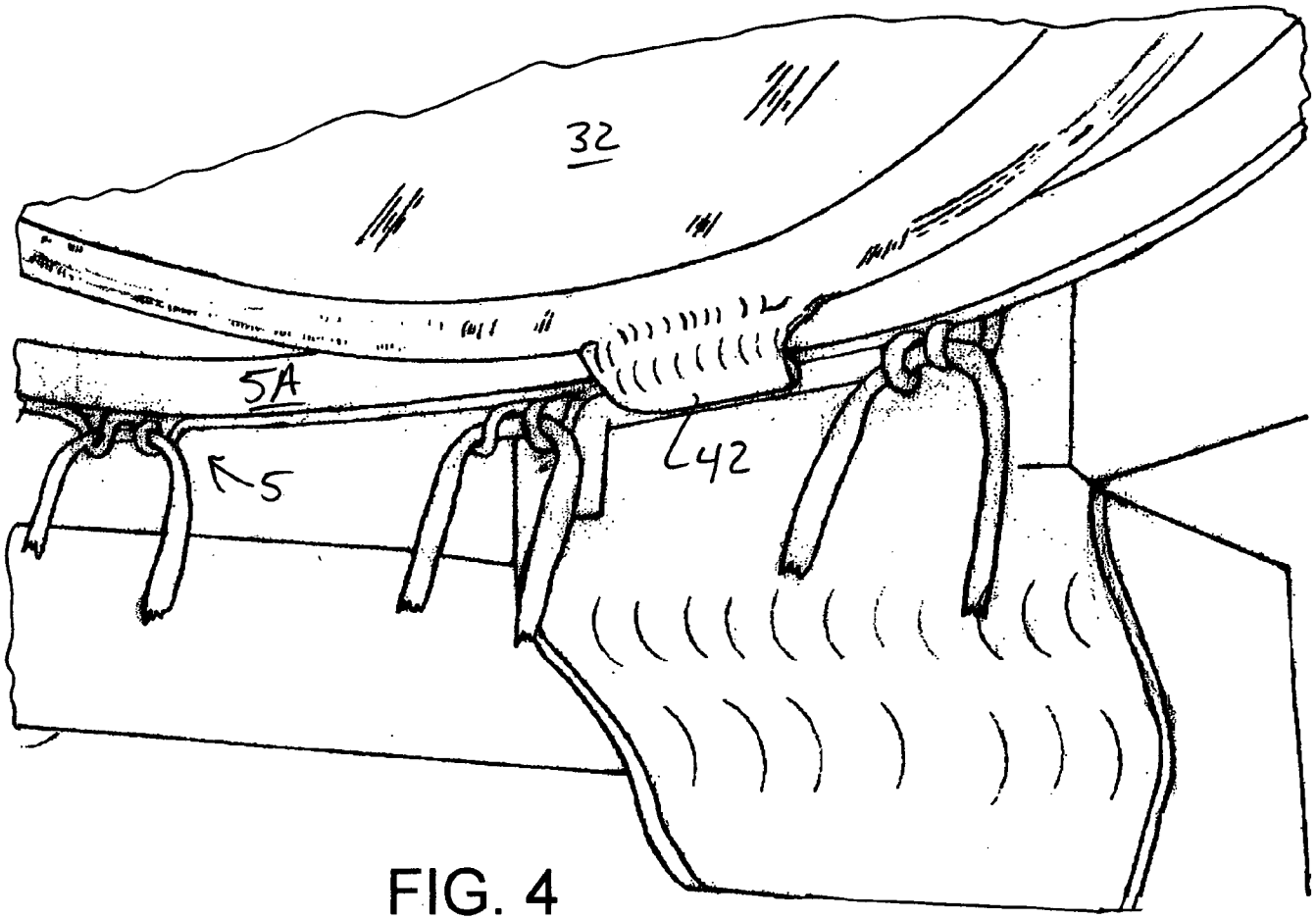
FIG. 4 is a first perspective view of the rim catch portion of the rebound unit.
Figure 5A:
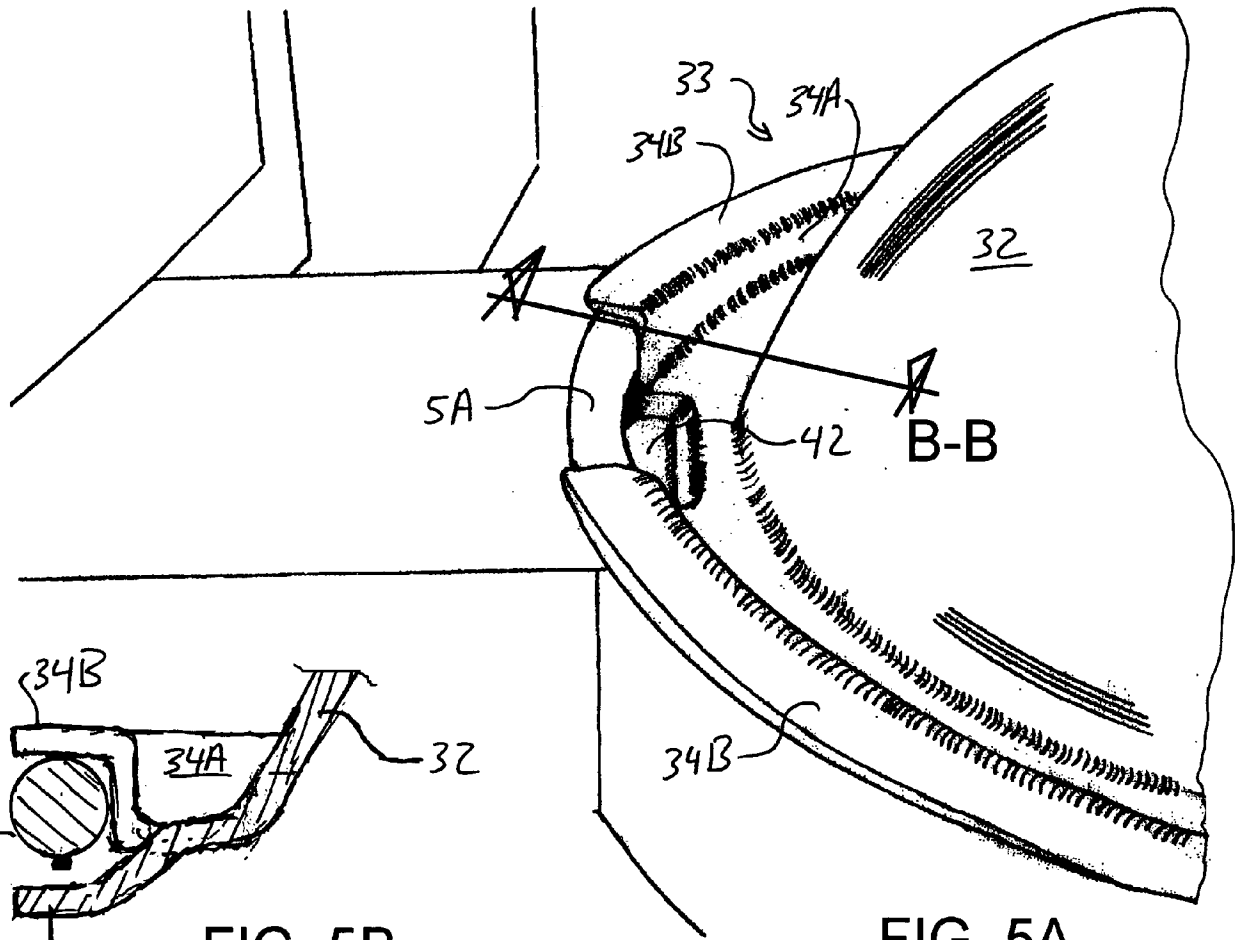
FIG. 5A is a second perspective view of the rim catch portion of the rebound unit.
Figure 5B:
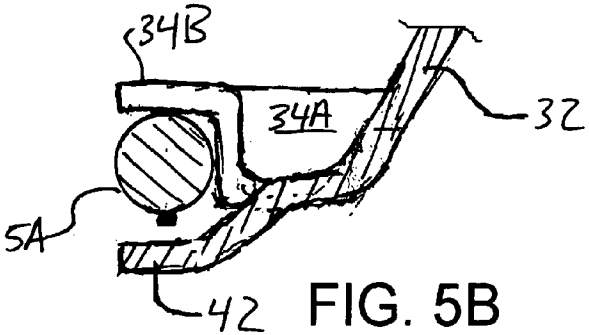
FIG. 5B is a sectional view of the rim catch portion of a basketball rebound device taken from plane B-B of FIG. 5A.
Figure 6:
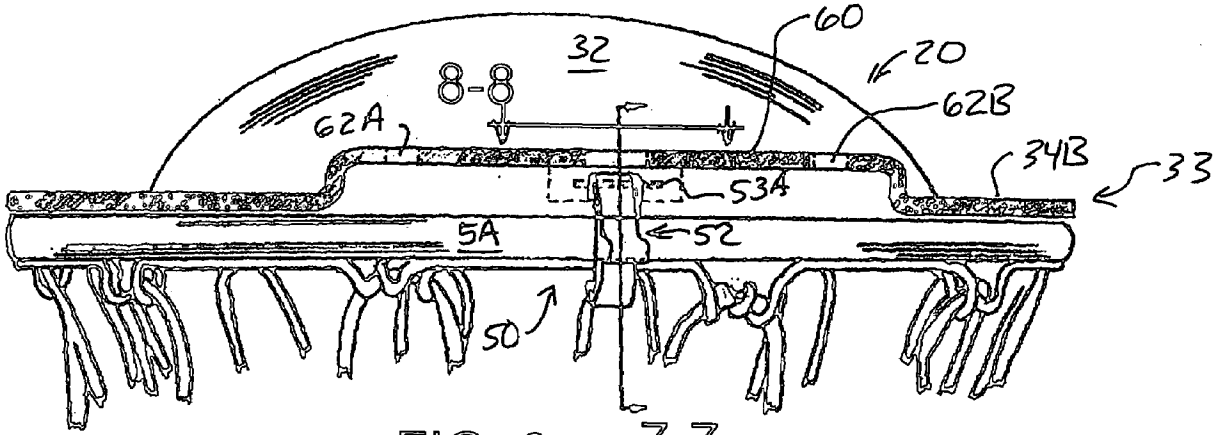
FIG. 6 is a perspective view of the latch mechanism of the rebound unit.

Dome portion 32 is shaped to deflect basketball shots in directions that will generally mimic the direction of a similar missed shot. The shape of dome portion 32 can be better understood by referring to FIG. 2A. In FIG. 2A, the inside diameter of goal rim 5A is a regulation 18 inches. Preferably the cross section of dome portion 32 describes a generally elliptical shape such that dimension D is approximately between 3 and 4 inches, radius R1 is approximately between 13 and 17 inches and radius R2 is approximately between 3 and 4 inches. Peripheral ledge portion 34 includes an outer wall 34A and a horizontal flange 34B. For example, the applicants have found by trial and error that a dome portion 32 with dimensions D=3.625, R1=15 and R2=3.5 gives a dome which tends to deflect basketball shots to the general court location corresponding to a similar missed shot.

As noted above, rim mount structure 33 includes peripheral ledge portion 34. Peripheral ledge portion 34 includes an outer wall 34A and a generally horizontal flange 34B. Outer wall 34A is sized to fit inside the inside limits of basketball goal rim 5A. Horizontal flange 34B is adapted to rest on top of the top surface of basketball goal rim 5A. Thus, outer wall 34A and horizontal flange 34B define a form for seating within basketball goal rim 5A. Rim catch portion 40 interrupts peripheral ledge portion 34 and more particularly is a feature formed by interrupting horizontal flange 34B. Rim catch portion 40 includes a rim catch tab 42 which is shaped to extend under the rim of basketball goal 5A. Accordingly rim catch tab 42 and adjacent portions of horizontal flange 34B as well as portions of outer wall 34A close to rim catch tab 42 cooperate to present a channel like form for engaging rim 5A.

Figures 10A, 10B, 11A, 11B, 12A, 12B, 12C:
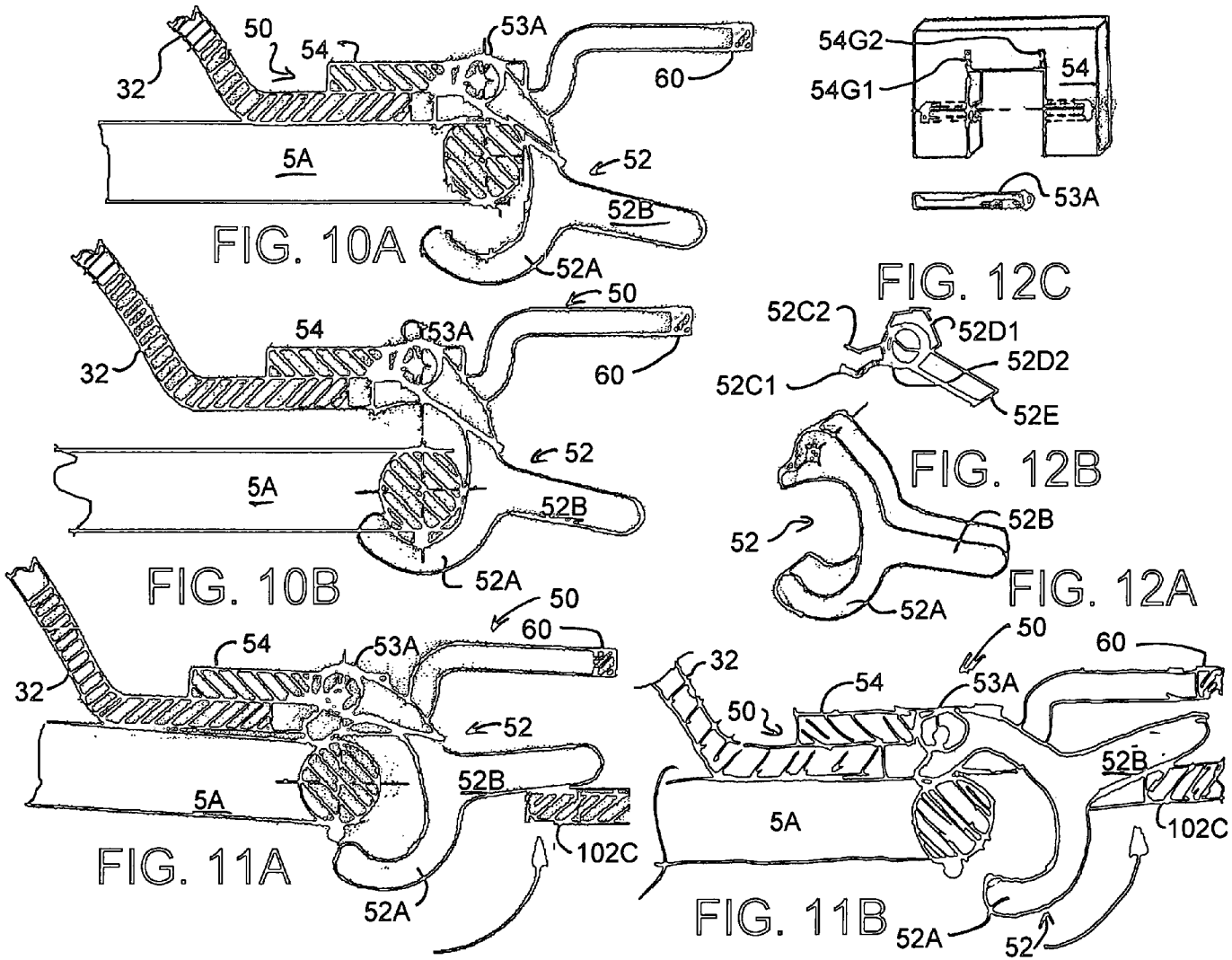
FIG. 10A is a first sectional view of the latch mechanism of the rebound unit in the closed position.
FIG. 10B is a second sectional view of the latch mechanism of the rebound unit in the closed position.
FIG. 11A is a sectional view of the latch mechanism of the rebound unit in a partially opened position.
FIG. 11B is a sectional view of the latch mechanism of the rebound unit in an opened position.
FIG. 12A is a perspective view of the latch member of the latch mechanism.
FIG. 12B is a perspective view of the spring of the latch mechanism.
FIG. 12C is a perspective view of the latch pin support fitting of the latch mechanism.

Latch mechanism 50 is located generally opposite rim catch tab 42. The purpose of latch mechanism 50 is to cooperate with rim catch tab 42 to capture rim 5A and thus secure rebound unit 20 to basketball goal 5. Latch mechanism 50 generally includes a latch flange 60 and a latch member 52. Generally, latch member 52 is mounted for pivoting movement relative to a latch flange 60. As can be best seen in FIGS. 7-12C, latch member 52 includes a "C" shaped jaw portion 52A for engaging the rim 5A and a lever portion 52B which extends away from jaw portion 52A. A latch pin support fitting 54 is mounted to latch flange 60. Latch member 52 is pivotably mounted to latch pin support fitting 54 by a latch pin 53A. Latch member 52 pivots between a closed position shown in FIG. 10A and an open position shown in FIG. 11. Latch member 52 is biased by a latch spring 52C toward the closed position. As can be best seen in FIGS. 12-12C, latch spring 52C includes two generally parallel prongs 52C1 and 52C2, parallel spaced loop portions 52D1 and 52D2 and brace portion 52E. Parallel prongs 52C1 and 52C2 seat within prong grooves 54G1 and 54G2 which are defined in latch pin support fitting 54. Parallel spaced loop portions 52D1 and 52D2 receive latch pin 53A. Brace portion 52E contacts jaw portion 52A of latch member 52 and thus biases latch member 52 in a clockwise direction as seen in FIGS. 10A and 11 toward the closed position shown in FIG. 10A.

Figure 7:
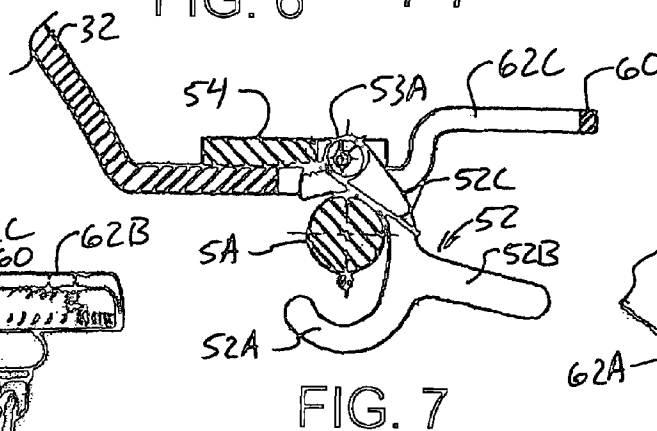
FIG. 7 is a sectional view of the latch mechanism of the rebound unit taken from plane 7-7 of FIG. 6.
Figure 8:
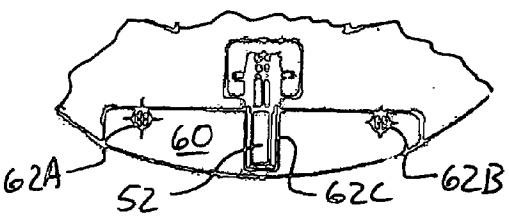
FIG. 8 is a top view of the latch mechanism of the rebound unit taken from plane 8-8 of FIG. 6.
Figure 9:
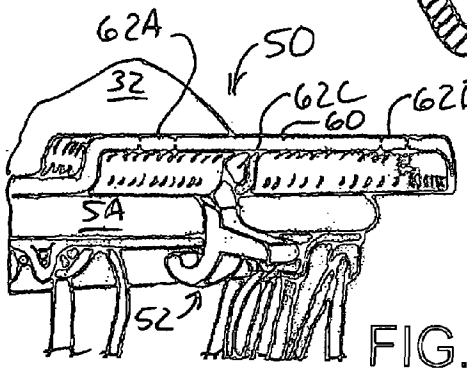
FIG. 9 is a perspective view of the latch mechanism of the rebound unit.

As can be seen in FIGS. 7-8, latch flange 60 interrupts peripheral ledge portion 34 and is adapted for supporting latch member 52 and for providing an interface for installation tool 100 as will be described in greater detail below. Latch flange 60 includes a latch slot 62C and spaced holes 62A and 62B. Latch slot 62C is shaped to receive latch member 52. Spaced holes 62A and 62B receive upright pins associated with installation tool 100. As can be best seen in FIGS. 7, 10A and 10B, latch pin support fitting 54 and latch slot 62C are arranged so that the top outside corner of jaw portion 52A contacts latch pin support fitting 54 thus preventing the rotation of latch member 52 past the position shown in FIG. 10A. As can be seen in FIG. 11, the top inside corner of jaw portion 52A contacts rim 5A as latch member 52 is rotated in a counterclockwise direction. Thus, pushing lever portion 52B of latch member 52 toward latch flange 60 causes the latch mechanism end of rebound unit 20 to be lifted relative to rim 5A as latch member 52 releases rim 5A.

Figure 13:
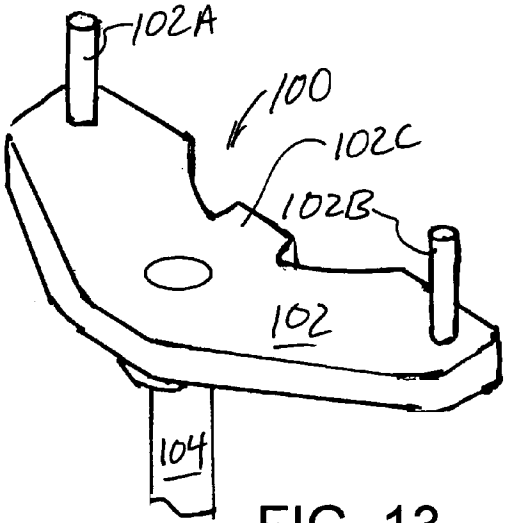
FIG. 13 is a perspective view of the installation tool.
Figure 13C:
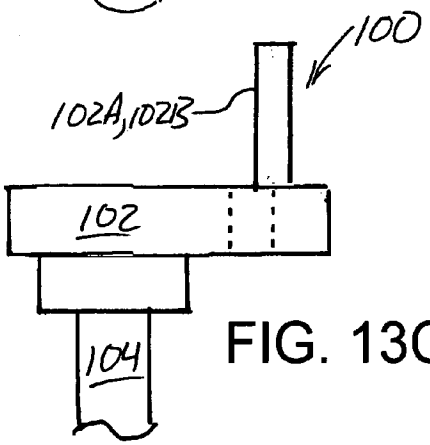
FIG. 13C is a side view of the installation tool.
Figure 13A:
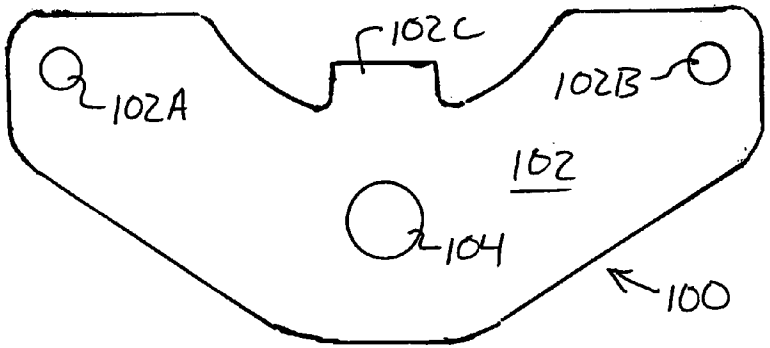
FIG. 13A is a top view of the installation tool.
Figure 13B:
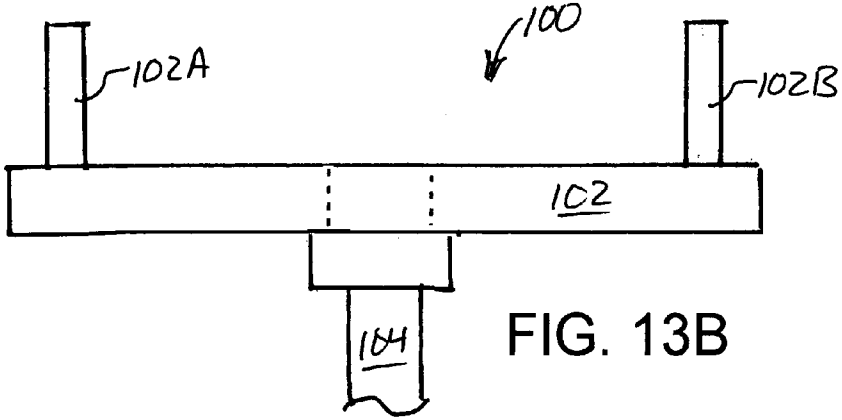
FIG. 13B is an end view of the installation tool.
Figure 14:
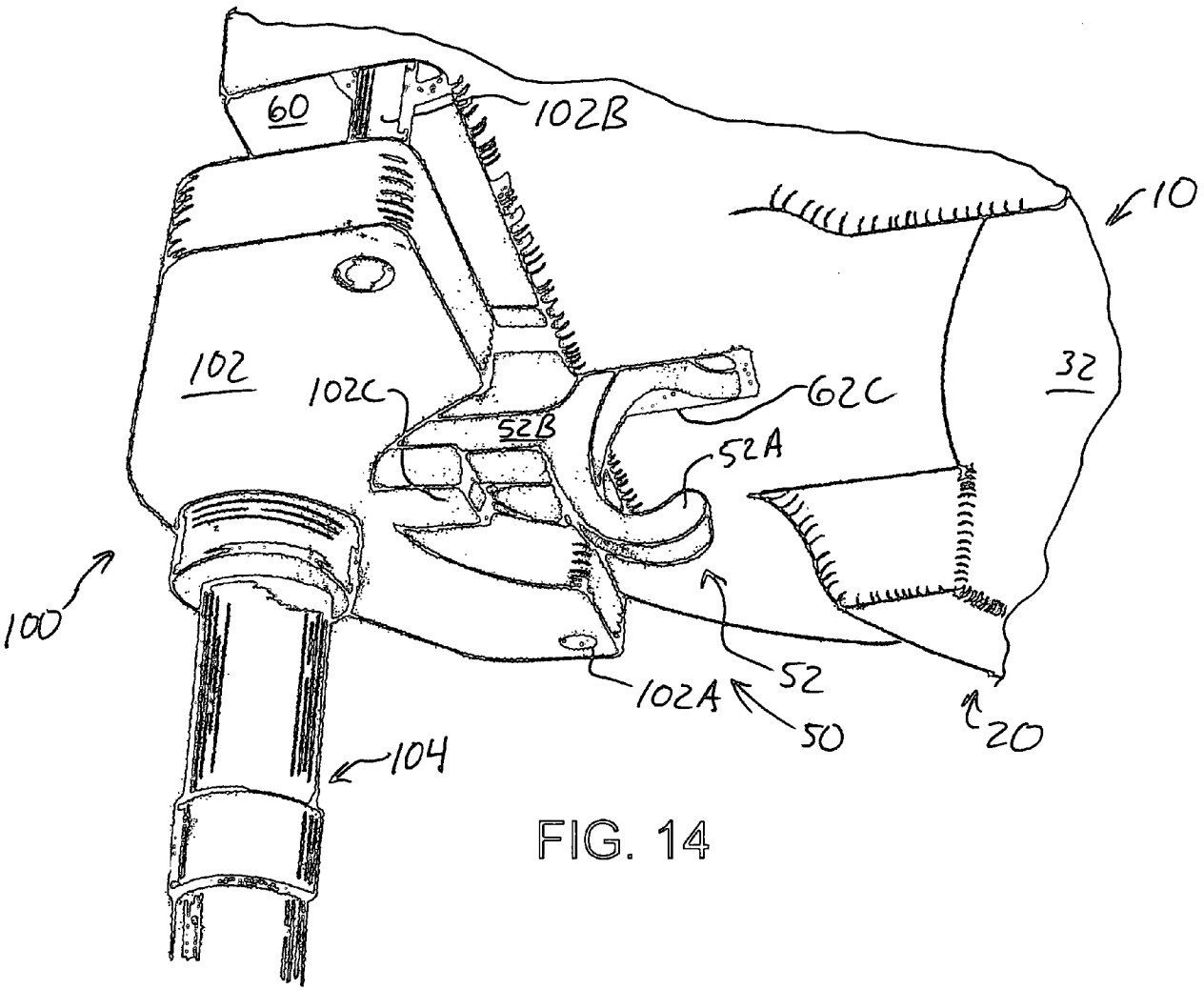
FIG. 14 is a perspective view of the installation tool and the latch mechanism of the basketball rebound training apparatus.
Figure 15:
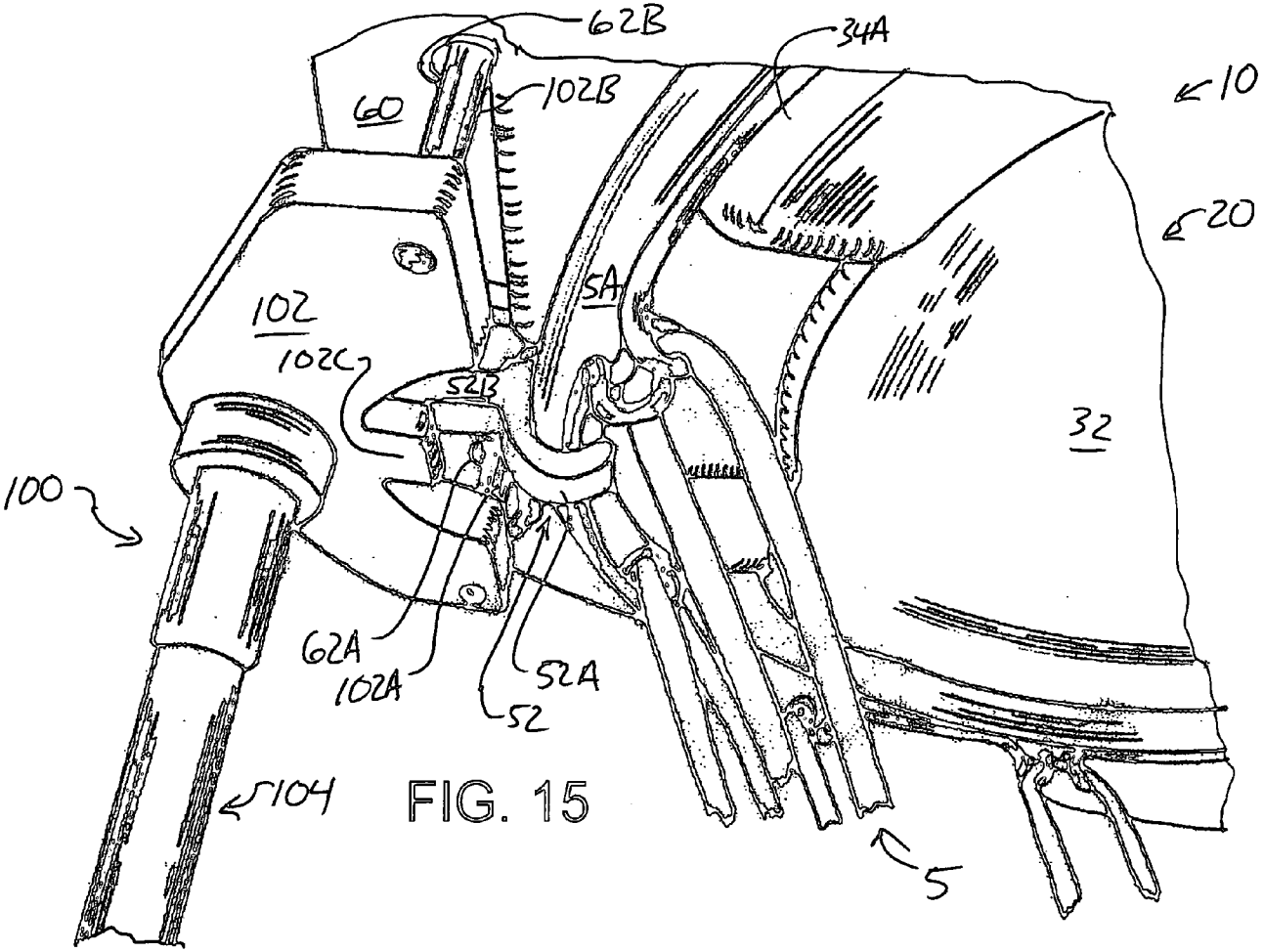
FIG. 15 is a perspective view of the installation tool and the latch mechanism of the basketball rebound training apparatus shown with the latch mechanism engaging a basketball goal rim.

Installation tool 100 is shown in FIGS. 13-13C and shown in use in FIGS. 14 and 15. The basic purpose of installation tool 100 is to lift rebound unit 20 so that rebound unit 20 can be lifted and installed onto a basketball goal rim. Installation tool 100 includes a support fitting 102 mounted upon a support pole 104. FIG. 13 shows a cut away view of support pole 104. Because basketball goal 5 is positioned as much as 10 feet above the court surface, it is preferable that support pole 104 have a length of at least six feet. Support fitting 102 includes two upright pins 102A and 102B which are spaced to engage holes 62A and 62B of latch flange 60. Support fitting 102 of the installation tool 100 also includes a tab 102C which is shaped to engage lever portion 52B of latch member 52. Accordingly, when installation tool 100 engages rebound unit 20, tab 102C is urging against lever portion 52B of latch member 52. This causes latch member 52 to rotate into the open position shown in FIG. 11. If this action occurs when rebound unit 20 is mounted on basketball rim 5A, then, as shown in FIG. 11, tab 102C urges lever portion 52B up and causes latch member 52 to rotate counterclockwise about pin 53A. When tool 100 is withdrawn from rebound unit 20, latch member 52 rotates into a closed position as shown in FIG. 10A. When in this closed position, latch member 52 cooperates with rim catch tab 42 on the opposite side of rebound unit 20 to secure rebound unit 20 to basketball goal rim 5A, thus preventing rebound unit 20 from bouncing off of rim 5A in response to a practice shot. The relative positions of rim 5A, rim catch tab 42 and latch member 52 when rebound unit 20 is mounted on rim 5A of goal 5 can be understood by inspecting FIGS. 5B and 7.

Accordingly, installation tool 100 can be used in combination with rebound unit 20 to install or remove rebound unit 20 without the use of step ladders and the like. The installation and removal of rebound unit 20 may be accomplished with the following steps. Upright pins 102A and 102B of installation tool 100 are inserted into holes 62A and 62B of rebound unit latch flange 60. This mating of installation tool 100 with rebound unit 20 causes tab 102C to push against lever portion 52B of latch member 52 thus urging latch member 52 into the open position. Rebound unit 20 may then be raised using installation tool 100 and positioned until rim catch tab 42 slides under rim 5A near the back stop of goal 5. The end of rebound unit 20 opposite rim catch tab 42 may then be lowered as open latch member 52 clears rim 5A. Installation tool 100 is disengaged from rebound unit 20 as latch member 52 rotates from the open position shown in FIG. 11B to the closed position shown in FIG. 10A. Once latch member 52 is in the closed position, then rim catch tab 42, rim 5A and latch member 52 are in the relative positions shown in FIGS. 5B and 7.

The removal of rebound unit 20 is accomplished with a series of steps generally reversed from those described above. Installation tool 100 is engaged with rebound unit 20 so that pins 102A and 102B engage holes 62A and 62B of latch flange 60. Tab 102C of installation tool 100 engages lever portion 52B of latch member 52 causing latch member 52 to rotate from the position shown in FIG. 10A to the position shown in FIG. 11A and finally to the position shown in FIG. 11B. When latch member 52 is rotated into the open position shown in FIG. 11B, rebound unit 20 may be lifted from rim 5A as rim catch tab 42 is moved away from rim 5A. Rebound unit 20 may then be lowered and stored for subsequent use.

As can be seen from the above description, rebound apparatus 10 provides a rebound unit 20 which may be easily installed and removed without resorting to using a step ladder. Further, the domed shape body portion 32 of rebound unit 20 presents a deflecting surface which causes basketball shots to bounce away from the basketball goal at an angle and direction and along a path which generally corresponds to the rebound path of a similar missed shot. This configuration trains players to move to a position where a successful rebound will most likely occur. Still further, mount structure 33 provides an effective means for mounting any one of a number of basketball training devices to a basketball goal rim. For example, such other devices might, in place of a dome portion for deflecting practice shots for rebound training, have a secondary, elevated undersized rim. Such an elevated, undersized rim functions to receive highly preferred arc shaped practice shots and also functions to deflect the less preferred flat shaped practice shots.

It is to be understood that while certain forms of this invention have been illustrated and described, it is not limited thereto, except in so far as such limitations are included in the following claims and allowable equivalents thereof.

Having thus described the invention, what is claimed as new and desired to be secured by Letters Patent is:

1. A system for mounting a training apparatus to a basketball goal, comprising:

(a) a rim mount structure for supporting a training apparatus including, (i) a peripheral ledge portion presenting surfaces for resting upon and fitting inside a rim of a basketball goal, (ii) a rim catch portion interrupting said peripheral ledge portion having a rim catch tab for fitting under said basketball goal rim, and, (iii) a latch mechanism also interrupting said peripheral ledge portion disposed generally opposite said rim catch portion, said latch mechanism including a latch member having a generally C shaped jaw portion and a lever portion extending from said jaw portion, said latch member pivotably mounted within said latch mechanism for pivoting between an open position for receiving said basketball rim and a closed position for capturing said basketball rim, said latch member biased in said closed position, (b) an installation tool for lifting and placing said rim mount structure for installation on a basketball goal rim, said installation tool including a support fitting adapted for supporting said rim mount structure and urging said latch member in said open position when supporting said rim mount structure, whereby said installation tool may be used to lift said rim mount structure for engagement of said rim catch portion with said basketball goal rim and engagement of said latch member with said basketball goal rim, such that said latch member closes to capture said basketball goal rim as said installation tool is withdrawn from said rim mount structure.

2. The system of claim 1, wherein, said peripheral ledge portion includes an outer wall adapted for fitting inside the inside diameter of a basketball goal rim and a generally horizontal flange extending radially from said outer wall for resting on top of said basketball goal rim, said outer wall and said horizontal flange defining a form for seating within said basketball goal rim.

3. The system of claim 1, wherein, said latch mechanism includes a generally horizontal latch flange and said latch member is pivotably mounted to said latch flange.

4. The system of claim 1, wherein, said latch mechanism includes a generally horizontal latch flange and said latch member is pivotably mounted to said latch flange, said latch flange further including a pair of generally upright holes disposed generally on either side of said latch member, and, said installation tool includes a support fitting having a pair of upright pins spaced for engaging said upright holes of said latch flange.

5. The system of claim 1, wherein, said latch mechanism includes a generally horizontal latch flange and said latch member is pivotably mounted to said latch flange, said latch flange further including a pair of generally upright holes disposed generally on either side of said latch member, and, said installation tool includes a support fitting having a pair of upright pins spaced for engaging said upright holes of said latch flange, said support fitting shaped for fitting against said latch flange and including a tab for contacting said lever portion of said latch member for pivoting said latch member into said open position when said support fitting is supporting said rim mount structure.

6. A system for mounting a training apparatus to a basketball goal, comprising:

(a) a rim mount structure for supporting a training apparatus including, (i) a peripheral ledge portion including an outer wall adapted for fitting inside the inside diameter of a basketball goal rim and a generally horizontal flange extending radially from said outer wall for resting on top of said basketball goal rim, said outer wall and said horizontal flange defining a form for seating within said basketball goal rim, (ii) a rim catch portion interrupting said peripheral ledge portion, said rim catch portion including a rim catch tab which is shaped to extend under said basketball goal rim, said rim catch portion and adjacent portions of said of said peripheral ledge portion arranged to present a channel for receiving a portion of said basketball goal rim, and, (iii) a latch mechanism also interrupting said peripheral ledge portion generally opposite from said rim catch portion, said latch mechanism including a generally horizontal latch flange and a latch member, said latch member having a generally C shaped jaw portion and a lever portion extending from said jaw portion, said latch member pivotably mounted to said latch flange for pivoting between an open position for receiving said basketball rim and a closed position for capturing said basketball rim, said latch member biased in said closed position, said latch flange having a slot for passage of said lever portion of said latch member as said latch member pivots into said open position and said latch flange further including a pair of generally upright holes disposed generally on either side of said slot, (b) an installation tool including;

(i) a support fitting including a pair of upright pins spaced for engaging said upright holes of said latch flange, said support fitting shaped for fitting against said latch flange and including a tab for contacting said lever portion of said latch member for pivoting said latch member into said open position, and, (ii) a support pole for lifting said support fitting to an elevated position, whereby said rim mount structure may be supported by said installation tool as said latch member is retained in said open position as said rim mount structure is lifted and mated with said basketball goal rim so that said rim catch portion engages a first portion of said basketball goal rim and so that said latch member engages a generally opposite second portion of said basketball goal rim, said latch member closing to capture said second portion of said basketball goal rim as said installation tool is withdrawn from engagement with said lever portion of said latch member and said support flange.

7. A basketball training apparatus for deflecting practice goal shots for rebound practice, comprising:

(a) a dome portion for shielding a basketball goal and for deflecting basketball practice shots for rebound practice, (b) a rim mount structure for supporting said dome portion including, (i) a peripheral ledge portion presenting surfaces for resting upon and fitting inside a rim of a basketball goal, (ii) a rim catch portion interrupting said peripheral ledge portion having a rim catch tab for fitting under said basketball goal rim, and, (iii) a latch mechanism also interrupting said peripheral ledge portion disposed generally opposite said rim catch portion, said latch mechanism including a latch member having a generally C shaped jaw portion and a lever portion extending from said jaw portion, said latch member pivotably mounted within said latch mechanism for pivoting between an open position for receiving said basketball rim and a closed position for capturing said basketball rim, said latch member biased in said closed position, (b) an installation tool for lifting and placing said rim mount structure for installation on a basketball goal rim, said installation tool including a support fitting adapted for supporting said rim mount structure and urging said latch member in said open position when supporting said rim mount structure, whereby said installation tool may be used to lift said rim mount structure for engagement of said rim catch portion with said basketball goal rim and engagement of said latch member with said basketball goal rim, such that said latch member closes to capture said basketball goal rim as said installation tool is withdrawn from said rim mount structure.

8. The basketball training apparatus of claim 7 wherein;

said dome portion is a generally flattened dome having a height above the rim of approximately between 3 and 8 inches and a radius of curvature near its center of approximately between 10 and 25 inches.

9. The basketball training apparatus of claim 7 wherein, said dome portion and said rim mount structure are formed together as a single continuous part from molded plastic.

10. The basketball training apparatus of claim 7 wherein, said dome portion and said rim mount structure are formed together as a single continuous part from molded plastic, and, said dome portion is a generally flattened dome having a height above the rim of approximately between 3 and 8 inches and a radius of curvature near its center of approximately between 10 and 25 inches.

11. The basketball training apparatus of claim 7 wherein;

said peripheral ledge portion includes an outer wall adapted for fitting inside the inside diameter of a basketball goal rim and a generally horizontal flange extending radially from said outer wall for resting on top of said basketball goal rim, said outer wall and said horizontal flange defining a form for seating within said basketball goal rim.

12. The basketball training apparatus of claim 7 wherein;

said latch mechanism includes a generally horizontal latch flange and said latch member is pivotably mounted to said latch flange.

13. The basketball training apparatus of claim 7 wherein;

said latch mechanism includes a generally horizontal latch flange and said latch member is pivotably mounted to said latch flange, said latch flange further including a pair of generally upright holes disposed generally on either side of said latch member, and, said installation tool includes a support fitting having a pair of upright pins spaced for engaging said upright holes of said latch flange.

14. The basketball training apparatus of claim 7 wherein;

said latch mechanism includes a generally horizontal latch flange and said latch member is pivotably mounted to said latch flange, said latch flange further including a pair of generally upright holes disposed generally on either side of said latch member, and, said installation tool includes a support fitting having a pair of upright pins spaced for engaging said upright holes of said latch flange, said support fitting shaped for fitting against said latch flange and including a tab for contacting said lever portion of said latch member for pivoting said latch member into said open position when said support fitting is supporting said rim mount structure.

15. A basketball training apparatus for deflecting practice goal shots for rebound practice, comprising:

(a) a dome portion for shielding a basketball goal and for deflecting basketball practice shots for rebound practice, (b) a rim mount structure for supporting said dome portion including, (i) a peripheral ledge portion including an outer wall adapted for fitting inside the inside diameter of a basketball goal rim and a generally horizontal flange extending radially from said outer wall for resting on top of said basketball goal rim, said outer wall and said horizontal flange defining a form for seating within said basketball goal rim, (ii) a rim catch portion interrupting said peripheral ledge portion, said rim catch portion including a rim catch tab which is shaped to extend under said basketball goal rim, said rim catch portion and adjacent portions of said of said peripheral ledge portion arranged to present a channel for receiving a portion of said basketball goal rim, and, (iii) a latch mechanism also interrupting said peripheral ledge portion generally opposite from said rim catch portion, said latch mechanism including a generally horizontal latch flange and a latch member, said latch member having a generally C shaped jaw portion and a lever portion extending from said jaw portion, said latch member pivotably mounted to said latch flange for pivoting between an open position for receiving said basketball rim and a closed position for capturing said basketball rim, said latch member biased in said closed position, said latch flange having a slot for passage of said lever portion of said latch member as said latch member pivots into said open position and said latch flange further including a pair of generally upright holes disposed generally on either side of said slot, (b) an installation tool including;

(i) a support fitting including a pair of upright pins spaced for engaging said upright holes of said latch flange, said support fitting shaped for fitting against said latch flange and including a tab for contacting said lever portion of said latch member for pivoting said latch member into said open position, and, (ii) a support pole for lifting said support fitting to an elevated position, whereby said rim mount structure may be supported by said installation tool as said latch member is retained in said open position as said rim mount structure is lifted and mated with said basketball goal rim so that said rim catch portion engages a first portion of said basketball goal rim and so that said latch member engages a generally opposite second portion of said basketball goal rim, said latch member closing to capture said second portion of said basketball goal rim as said installation tool is withdrawn from engagement with said lever portion of said latch member and said support flange.

16. The basketball training apparatus of claim 15 wherein;

said dome portion is a generally flattened dome having a height above the rim of approximately between 3 and 8 inches and a radius of curvature near its center of approximately between 10 and 25 inches.

17. The basketball training apparatus of claim 15 wherein, said dome portion and said rim mount structure are formed together as a single continuous part from molded plastic.

18. The basketball training apparatus of claim 15 wherein, said dome portion and said rim mount structure are formed together as a single continuous part from molded plastic, and, said dome portion is a generally flattened dome having a height above the rim of approximately between 3 and 8 inches and a radius of curvature near its center of approximately between 10 and 25 inches.

* * * * *